US011486176B2

(12) United States Patent
Duer

(10) Patent No.: US 11,486,176 B2
(45) Date of Patent: Nov. 1, 2022

(54) FURNITURE FITTING

(71) Applicant: Julius Blum GmbH, Hoechst (AT)

(72) Inventor: Stefan Duer, Schwarzach (AT)

(73) Assignee: JULIUS BLUM GMBH, Hoechst (AT)

( * ) Notice: Subject to any disclaimer, the term of this patent is extended or adjusted under 35 U.S.C. 154(b) by 144 days.

(21) Appl. No.: 17/136,756

(22) Filed: Dec. 29, 2020

(65) Prior Publication Data

US 2021/0115714 A1 Apr. 22, 2021

Related U.S. Application Data

(63) Continuation of application No. PCT/AT2019/060211, filed on Jun. 27, 2019.

(30) Foreign Application Priority Data

Jul. 3, 2018 (AT) ..... A 50577/2018

(51) Int. Cl.
*E05D 7/04* (2006.01)
*E05D 5/02* (2006.01)
*E05D 7/00* (2006.01)

(52) U.S. Cl.
CPC ..... *E05D 5/0276* (2013.01); *E05D 7/0009* (2013.01); *E05Y 2900/20* (2013.01)

(58) Field of Classification Search
CPC ..... E05D 5/02; E05D 5/08; E05D 5/0215; E05D 5/0223; E05D 5/0238;
(Continued)

(56) References Cited

U.S. PATENT DOCUMENTS 1,556,742 A * 10/1925 Anderson ..... E05D 5/062 16/270
3,231,928 A * 2/1966 Hellmuth ..... E05D 3/18 16/382

(Continued)

FOREIGN PATENT DOCUMENTS

CN 107532444 1/2018
DE 7115374 8/1971

(Continued)

OTHER PUBLICATIONS

International Search Report dated Oct. 9, 2019 in International (PCT) Application No. PCT/AT2019/060211.

(Continued)

*Primary Examiner* — Chuck Y Mah
(74) *Attorney, Agent, or Firm* — Wenderoth, Lind & Ponack, L.L.P.

(57) ABSTRACT

A furniture fitting includes a first fitting portion to be fixed to a furniture carcass, and a second fitting portion to be fixed to a movable furniture part, the two fitting portions being pivotally connected by a hinge axis member. The first fitting portion can be inserted into a recess in the furniture carcass, and/or the second fitting portion can be inserted into a recess in the movable furniture part. The first fitting portion and/or the second fitting portion includes a longitudinal housing having two end sections spaced apart. The hinge axis member is arranged on a first end section of the housing, and the first fitting portion and/or the second fitting portion includes a fastening device having a movably-mounted actuating element formed as a rotatable screw. By actuating the actuating element, at least one fitting portion can be fixed within the recess on both end sections of the housing.

22 Claims, 8 Drawing Sheets

(58) Field of Classification Search
CPC ..... E05D 5/0276; E05D 5/046; E05D 5/16; E05D 7/0009; E05D 7/10; E05D 7/12; E05D 7/125; E05D 7/123; E05D 7/1061; E05D 2007/128; E05D 2007/1094; Y10T 16/554; Y10T 16/5543; Y10T 16/5547; Y10T 16/559; Y10T 16/535; Y10T 16/5363; Y10T 16/534; Y10T 16/5358; Y10T 16/5367; Y10T 16/5369
See application file for complete search history.

(56) References Cited

U.S. PATENT DOCUMENTS

| | | | | |
|---|---|---|---|---|
| 4,021,881 | A * | 5/1977 | Lautenschlager | E05D 5/08 16/383 |
| 4,085,481 | A * | 4/1978 | Lautenschlager | E05D 5/08 16/383 |
| 4,099,293 | A | 7/1978 | Pittasch | |
| 4,622,716 | A * | 11/1986 | Lautenschlager | E05D 5/08 16/384 |
| 4,832,388 | A * | 5/1989 | Lozano | E05B 15/0205 16/382 |
| 4,854,622 | A * | 8/1989 | Lozano | E05B 17/2084 16/382 |
| 5,561,888 | A | 10/1996 | Lautenschlager | |
| 5,577,297 | A * | 11/1996 | Lautenschlager | E05D 5/08 16/388 |
| 5,586,364 | A * | 12/1996 | Ferrari | F16B 21/02 411/46 |
| 5,613,796 | A | 3/1997 | Salice | |
| 5,711,054 | A * | 1/1998 | Salice | A47B 95/00 16/382 |
| 6,073,311 | A | 6/2000 | Lautenschlager | |
| 6,081,970 | A * | 7/2000 | Wasilewski | E05D 7/125 16/383 |
| 6,286,186 | B1 * | 9/2001 | Lautenschlager | A47B 95/00 16/272 |
| 8,689,515 | B2 * | 4/2014 | Oetlinger | E05D 5/0238 16/241 |
| 10,352,075 | B2 * | 7/2019 | Hirtsiefer | E05D 3/12 |
| 10,407,963 | B2 * | 9/2019 | Salice | E05D 3/142 |
| 10,508,673 | B2 * | 12/2019 | Haemmerle | A47B 88/463 |
| 10,590,688 | B2 * | 3/2020 | Salice | E05F 1/1058 |
| 11,028,627 | B2 | 6/2021 | Ohlenschlreger et al. | |
| 2005/0196249 | A1 * | 9/2005 | Huang | E05D 5/0276 411/60.1 |
| 2006/0064848 | A1 * | 3/2006 | Migli | E05D 7/125 16/270 |
| 2009/0199362 | A1 * | 8/2009 | Ferrari | E05D 7/125 16/242 |
| 2014/0096343 | A1 * | 4/2014 | Motosugi | E05D 5/0276 16/387 |
| 2018/0252016 | A1 | 9/2018 | Salice | |
| 2021/0079702 | A1 | 3/2021 | Ohlenschlreger et al. | |
| 2021/0148149 | A1 * | 5/2021 | Pleuteri | E05D 3/12 |

FOREIGN PATENT DOCUMENTS

| | | |
|---|---|---|
| DE | 1 966 537 | 6/1973 |
| DE | 2 353 043 | 6/1974 |
| DE | 25 24 503 | 12/1976 |
| DE | 25 54 130 | 6/1977 |
| DE | 43 43 805 | 6/1995 |
| DE | 295 06 600 | 9/1995 |
| DE | 297 17 508 | 10/1998 |
| EP | 0 552 606 | 7/1993 |
| EP | 0 881 348 | 12/1998 |
| EP | 1 439 276 | 7/2004 |
| EP | 3 252 255 | 12/2017 |
| GB | 977054 | 12/1964 |
| GB | 1323462 | 7/1973 |
| GB | 1 447 293 | 8/1976 |
| GB | 1542487 | 3/1979 |
| JP | 41-16811 | 8/1966 |
| JP | 2008-25270 | 2/2008 |
| JP | 2018-514670 | 6/2018 |
| WO | 2016/156514 | 10/2016 |
| WO | 2016/174071 | 11/2016 |

OTHER PUBLICATIONS

Search Report dated Nov. 1, 2021 in corresponding Chinese Patent Application No. 201980044484.0.
Office Action dated Nov. 17, 2021 in Japanese Application No. 2020-573187 with English translation thereof.

* cited by examiner

FURNITURE FITTING

BACKGROUND OF THE INVENTION

The present invention relates to a furniture fitting for movably supporting a movably-mounted furniture part relative to a furniture carcass. The furniture fitting includes a first fitting portion configured to be fixed to the furniture carcass, and a second fitting portion configured to be fixed to the movable furniture part, with the two fitting portions being pivotally connected to one another by at least one hinge axis member. The first fitting portion is configured to be at least partially inserted into a recess in the furniture carcass, and/or the second fitting portion is configured to be at least partially inserted into a recess in the movable furniture part. The first fitting portion and/or the second fitting portion includes a longitudinal housing having two end sections spaced from each other in the longitudinal direction, and the at least one hinge axis member is arranged on a first end section of the housing.

Moreover, the invention concerns an item of furniture comprising a furniture carcass and a movable furniture part which is movably supported relative to the furniture carcass by at least one fitting portion of the type to be described.

WO 2016/174071 A1 shows in FIG. 9 a furniture hinge for pivotally supporting a door. The second fitting portion is received within a recess of the door and is configured substantially L-shaped. The L-form of the second fitting portion is necessary, because in a region of the hinge axes of the two hinged levers connecting the first fitting portion to the second fitting portion to one another, there is no space available for the arrangement of a fastening screw. However, the L-shaped second fitting portion is a special type which, in serial production, requires an additional expenditure on materials and causes extra costs. Moreover, the L-shaped second fitting portion forms a relatively voluminous construction which does not sufficiently fulfil the need for a compact construction of the furniture fitting.

DE 1 966 537 A1 discloses a spreading and holding device for hinge portions for movably supporting a door. A recess is arranged in the door, and the recess has circled surfaces of an identical diameter overlapping one another, and the hinge portion is configured to be countersunk within the recess. The hinge portion includes a longitudinal housing having half-cylindrical end faces, and a rotatable eccentric having a slit for positioning a screwdriver is arranged on a first end section of the housing. A hinge axis member is arranged on a second end section of the housing. By rotating the eccentric with the aid of the screwdriver, an elastically yielding wall can be pressed against an inner side of the recess. A drawback is the fact the adjustment path of an eccentric is relatively limited. For a reliable fixing with the aid of the eccentric, the size of the recess must be exactly tailored to the size of the housing. If the size of the recess exceeds a predetermined dimension, a rotational movement of the eccentric, due to its eccentric curve configuration, leads to an abrupt decrease of the pressing force, whereby the housing can no longer be fixed within the recess.

DE 297 17 508 U1 discloses a furniture hinge having a hinge cup configured to be fixed within a bore of a furniture part by virtue of a handle pivotally mounted on the hinge cup. By a tilting movement of the handle, a bracket body can be pressed against an inner side of the bore. A drawback is the fact that the structural design of the furniture hinge is relatively complex.

SUMMARY OF THE INVENTION

It is an object of the present invention to propose a furniture fitting of the type mentioned in the introductory part, thereby avoiding the drawbacks as discussed above.

According to the invention, the first fitting portion and/or the second fitting portion includes or include a fastening device having at least one movably-mounted actuating element in the form of a rotatable screw. By an actuation of the at least one actuating element, the first fitting portion and/or the second fitting portion is or are configured to be fixed within the recess on both end sections of the housing.

Accordingly, the first fitting portion and/or second fitting portion includes or include a longitudinal housing having two end sections spaced from one another in the longitudinal direction. Each of the end sections, by an actuation of the actuating element, is configured to be pressed against a contact surface of the recess in the furniture carcass and/or in the movable furniture part either directly or via at least one locking element.

The actuating element of the fastening device can be arranged on a region separate from the first end section, on which the hinge axis member is arranged, of the housing. According to a possible embodiment, the actuating element of the fastening device is arranged on the second end section of the housing.

The first and/or the second fitting portion of the furniture fitting can have precisely one fastening device for fixing to the movable furniture part. In other words, one single fastening device of the fitting portions can be generally sufficient for reliably fixing to the furniture carcass and/or to the movable furniture part. However, if appropriate, additional securing means (for example a fastening screw) may be provided.

By an actuation of the actuating element, at least one locking element is movable, so that the housing can be fixed within the recess of the furniture carcass and/or within the recess of the movable furniture part by the at least one locking element.

Preferably, the actuating element, in all operating positions, is captively secured to the first and/or second fitting portion.

The actuating element can be connected to the locking element in a movement-coupled manner, for example by a transmission mechanism having co-operating tooth arrangements. With a constructively simple solution, the actuating element can be in threading engagement with the locking element.

With an embodiment of the invention, the at least one locking element includes a first inclined surface portion configured to co-operate with a corresponding second inclined surface portion. The at least one locking element is movable, due to the co-operation of the first and second inclined surface portions, in a first direction extending transversely to a rotational axis of the actuating element by rotating the actuating element in a first rotational direction. In this way, it is possible that the housing of the fitting portion(s) can be connected, by the locking element, in a force-locking manner with the contact surfaces of the recess which are provided for this purpose.

Thereby, the at least one locking element, by rotating the actuating element in a second rotational direction opposite the first rotational direction, can be movable by the co-operation of the first inclined surface portion and the second inclined surface portion, in a second direction opposite the first direction. In this way, it is possible to actively move back the locking element from a locking position within the recess into a position in which the housing of the second fitting portion can be removed from the recess, without damaging the associated contact surfaces and without any substantial frictional resistance.

The at least one locking element, at least over a region, can have a surface for increasing the static friction, for example nubs, ribs or a tooth arrangement, configured to bear against the recess.

According to an embodiment of the invention, the first fitting portion can include a mounting portion having at least one fixing device for mounting the mounting portion to a furniture panel. The first fitting portion includes at least one coupling portion hingedly connected to the second fitting portion, and the coupling portion is configured to be releasably connected to the mounting portion. In other words, the carcass-sided first fitting portion of the furniture fitting has at least a two-part configuration and includes a mounting portion which, in a first mounting step, is to be fixed to or within a horizontally or vertically extending furniture panel of the furniture carcass by the at least one fixing device. Further, a coupling portion is provided, the coupling portion being hingedly connected to the second fitting portion and being configured to be fixed—independently and separately from the mounting portion—to the movable furniture part in a second mounting step. After the mounting portion and the coupling portion have been pre-mounted, the mounting portion and the coupling portion are configured to be releasably connected to one another (preferably automatically locked to one another) in a third mounting step, whereby the mounting of the movable furniture part on the furniture carcass can be considerably facilitated.

The furniture panel of the furniture carcass usually has a predetermined material thickness (for example 16 mm or 19 mm). According to a preferred embodiment, the mounting portion of the first fitting portion is configured to be received within the predetermined material thickness of the furniture panel. The mounting portion can have a height extension and a longitudinal extension, and the length extension is at least three times, preferably at least six times, as large than the height extension of the mounting portion.

The furniture fitting, for example, can be configured as a furniture hinge. However, it is also possible that the furniture hinge is configured as a furniture drive for moving a furniture flap, the flap being pivotally mounted about a horizontally extending axis in a mounted condition on a furniture carcass.

According to an embodiment, the housing of the first and/or second fitting portion is configured substantially cuboid-shaped.

BRIEF DESCRIPTION OF THE DRAWINGS

Further details and advantages of the present invention will be explained with the aid of the embodiment shown in the figures.

DETAILED DESCRIPTION OF THE INVENTION

Figure 1A:
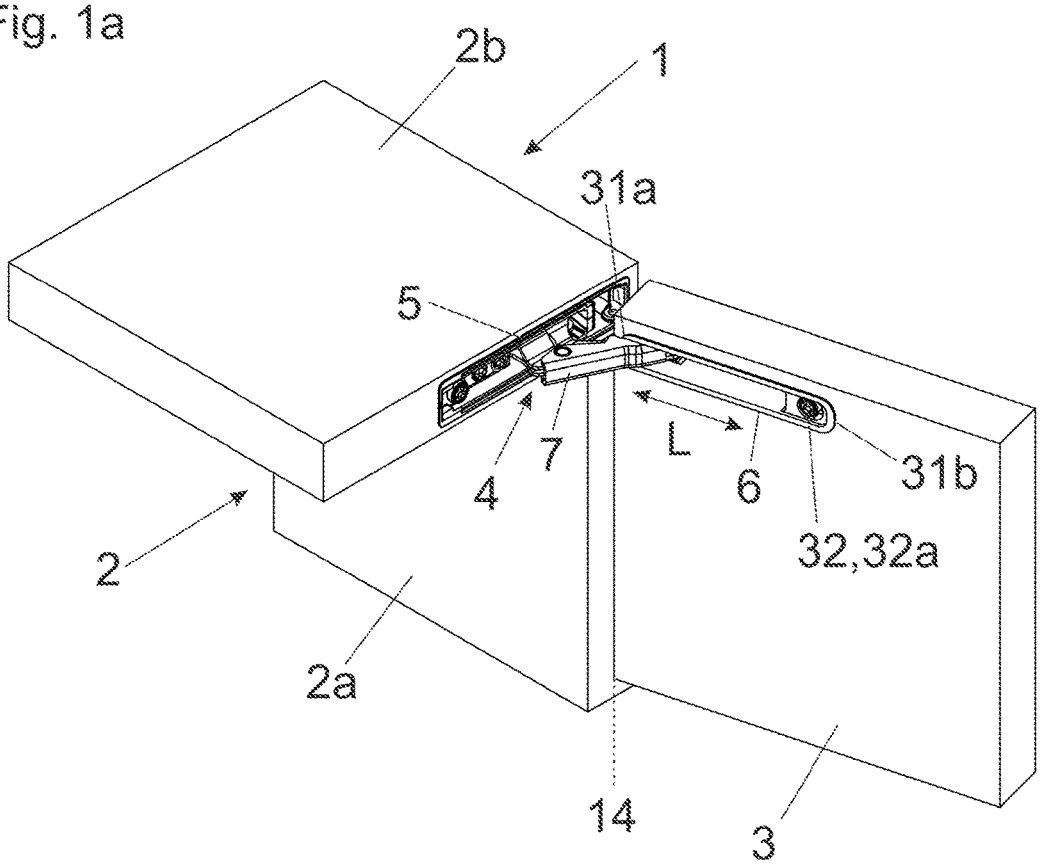
FIG. 1*a*, 1*b* show an item of furniture and a furniture fitting (without the mounting portion) in perspective views.

FIG. 1*a* shows a perspective view of an item of furniture 1 with a furniture carcass 2 which is only partially depicted. A movable furniture part 3, preferably in the form of a door or a furniture flap, is pivotally supported in the mounted position about an, preferably vertically extending, axis 14 relative to the furniture carcass 2 by a furniture fitting 4. The furniture carcass 2 includes a vertically extending sidewall 2*a* and a horizontally extending furniture panel 2*b* (preferably a top panel, a bottom panel or a shelf arranged between the top panel and the bottom panel), and the first fitting portion 5 of the furniture fitting 4 is supported on or within the furniture panel 2*b*. Of course, it is also possible for the furniture fitting 4 to be fixed to the vertically extending sidewall 2*a*, so that the movable furniture part 3, in the mounted condition, is pivotally supported relative to the furniture carcass 2 about a horizontally extending axis 14.

Figure 1B:
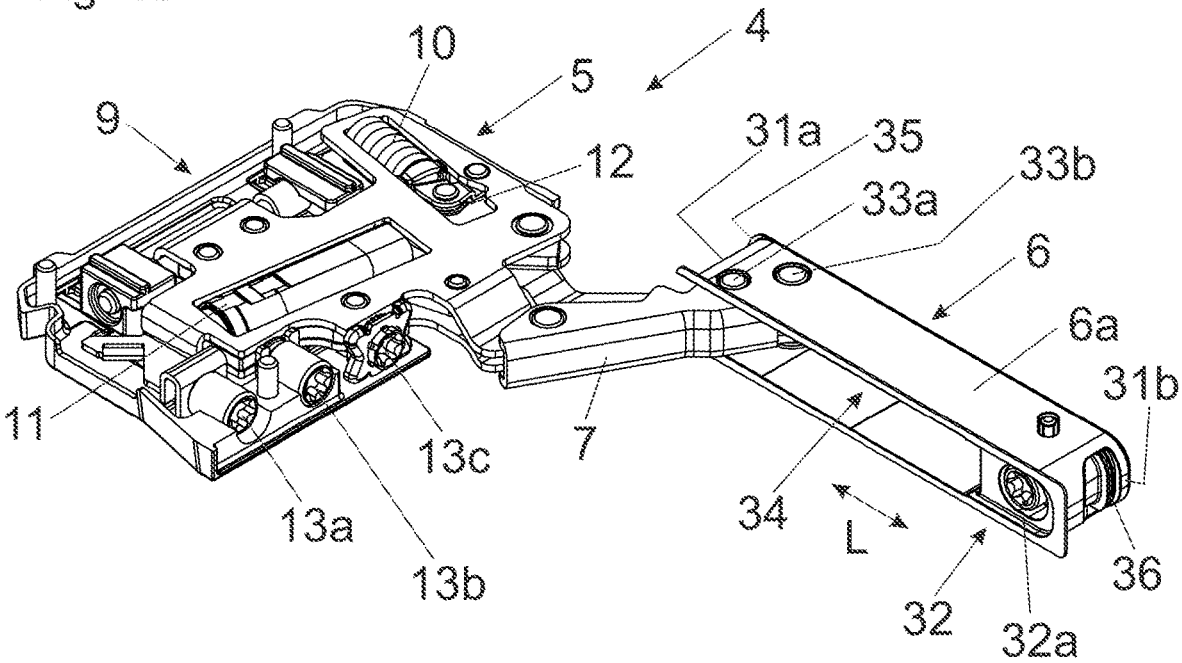
Figure 3A:
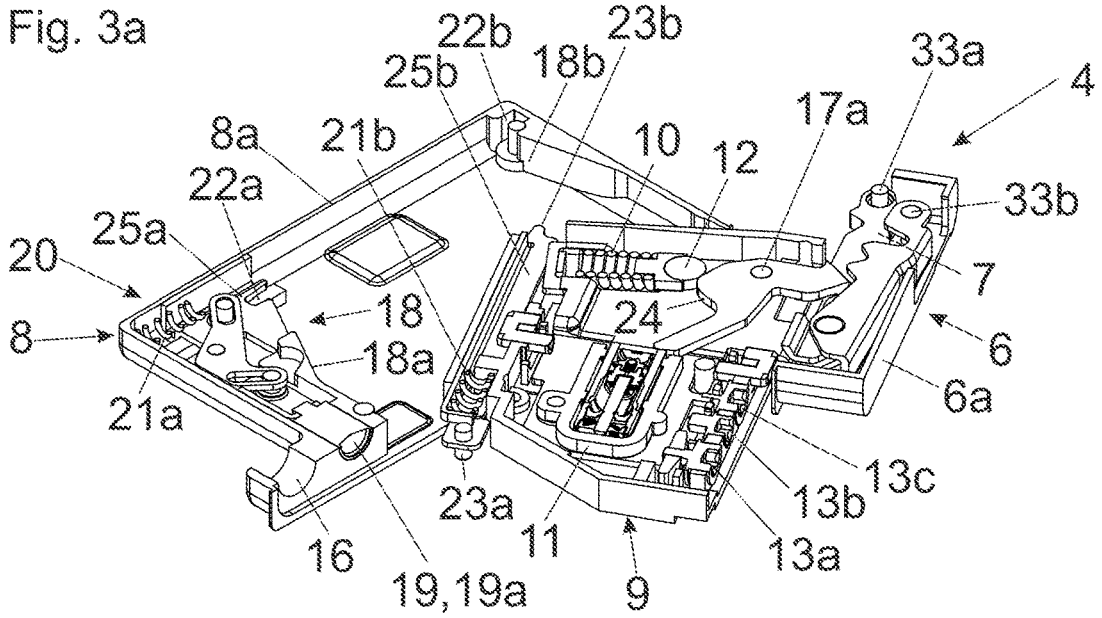
FIG. 3*a*-3*c* show a temporal sequence of the mounting procedure of the coupling portion to the mounting portion in different cross-sectional views.

FIG. 1*b* shows the furniture fitting 4 (without the mounting portion 8) in a perspective view. The first fitting portion 5 has at least a two-part configuration and includes a mounting portion 8 (FIG. 3*a*) configured to be pre-mounted to or within the furniture panel 2*b*. The mounting portion 8 has a, preferably pocket-shaped, housing 8*a* for at least partially receiving the coupling portion 9. The mounting portion 8 and the coupling portion 9 are configured to be releasably connected to one another. In a first mounting step, the mounting portion 8 is to be fixed to or within the furniture panel 2*b*. The coupling portion 9 is pivotally connected to the second fitting portion 6 by at least one hinged lever 7. The second fitting portion 6, in a second mounting step, is to be fixed to the movable furniture part 3 via a longitudinal housing 6*a*. After the mounting portion 8 has been fixed to the furniture panel 2*b* and the second fitting portion 6 has been fixed to the movable furniture part 3, the mounting portion 8 and the coupling portion 9 can be connected to one another by joining them together. For example, the mounting portion 8 and the coupling portion 9 can be fixed to one another by at least one screw connection. It is preferably provided that the mounting portion 8 and the coupling portion 9 are configured to be automatically locked to one another by at least one locking device 20 (FIG. 3*a*).

The second fitting portion 6 is pivotally connected to the first fitting portion 5 by at least one hinge axis member 33*a*, 33*b* (FIG. 1*b*). The second fitting portion 6 is configured to be at least partially inserted into a recess 15*b* in the movable furniture part 3. The second fitting portion 6 includes a longitudinal housing 6*a* with two end sections 31*a*, 31*b* spaced from one another in the longitudinal direction (L), and the housing 6*a* includes a cavity 34 for receiving the hinged lever 7 in at least one relative position of the furniture fitting 4. The at least one hinge axis member 33*a*, 33*b* is arranged on the first end section 31*a*, whereas a fastening device 32 with a rotatably mounted actuating element 32*a* in the form of a rotatable screw is provided on a region of the housing 6*a* which is separate from the first end section 31*a*. By an actuation of the actuating element 32*a*, the second fitting portion 6 can be fixed on both end sections 31*a*, 31*b* of the housing 6*a* within a recess 15*b* (FIG. 2*a*) of the movable furniture part 3. Thereby, it can be provided that by an actuation of the actuating element 32*a*, at least one locking element 36 can be pressed against a contact surface 40 (FIG. 5*c*) of the recess 15*b*.

On the first end section 31*a* of the housing 6*a*, on which the at least one hinge axis 33*a*, 33*b* is arranged, at least one protrusion 35 is arranged. The protrusion 35 can be pressed against a corresponding contact surface 40 of the recess 15*b* by an actuation of the actuating element 32*a*, whereby the grip of the first end section 31*a* of the housing 6*a* on the movable furniture part 3 can be additionally improved. If appropriate, the at least one protrusion 35 is configured to penetrate into the wood material of the movable furniture part 3 by an actuation of the actuating element 32*a*. Also, two or more protrusions 35 in the form of ribs, tooth arrangements or tips may be provided.

By at least one adjustment device 13*a*, 13*b*, 13*c*, in a connected condition between the mounting portion 8 and the coupling portion 9, a position of the coupling portion 9 relative to the mounting portion 8 can be adjusted, preferably in a three-dimensional manner. By a force of the spring device 10, the second fitting portion 6 is movable into the fully closed and/or fully open position relative to the first fitting portion 5. For example, this can be provided by a pressure roller 12 pressurized by the spring device 10. The pressure roller 12 is configured to run along a setting contour 24 (FIG. 3*a*) upon a movement of the hinged lever 7. By a damping device 11, preferably with a hydraulic piston-cylinder-unit, a movement of the second fitting portion 6 relative to the first fitting portion 5 can be decelerated. In this way, a movement of the second fitting portion 6 into the fully closed and/or fully open end-position can be dampened.

Figure 2A:
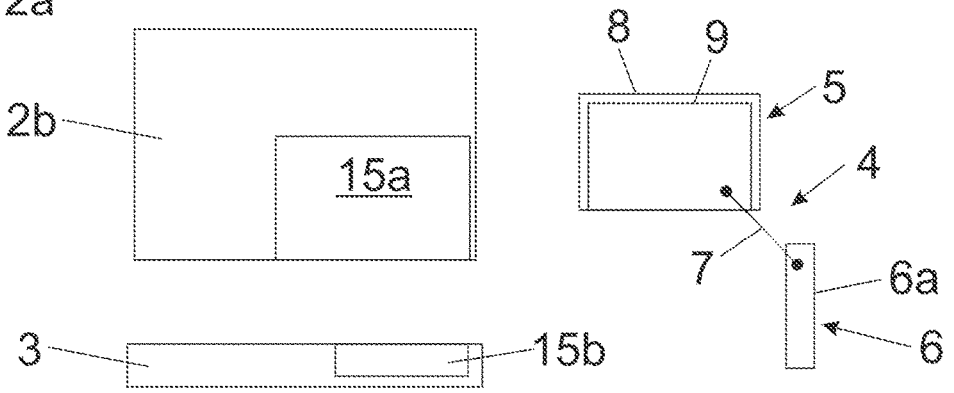
FIG. 2*a*-2*c* show the mounting procedure of the movable furniture part on the furniture carcass in schematic top views.
Figure 2B:
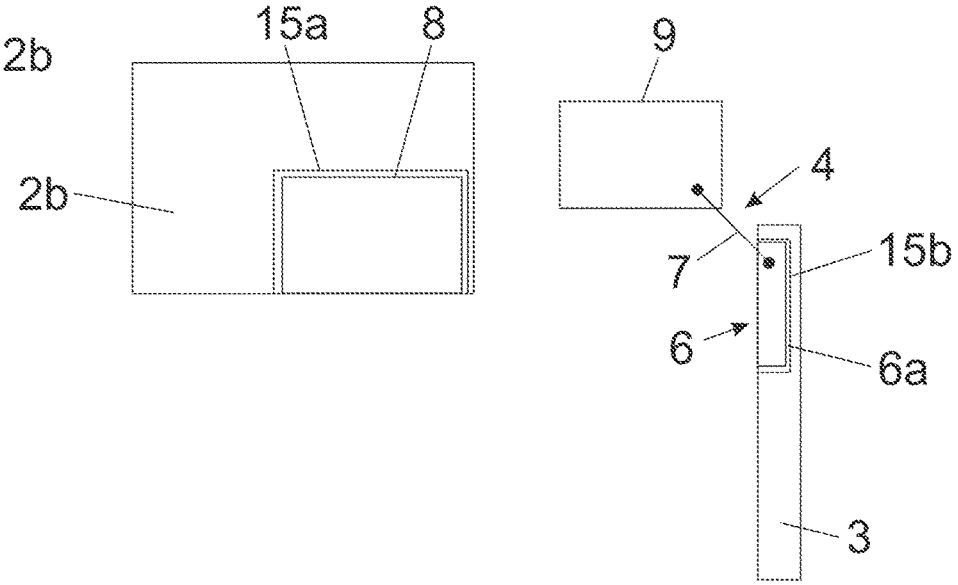
Figure 2C:
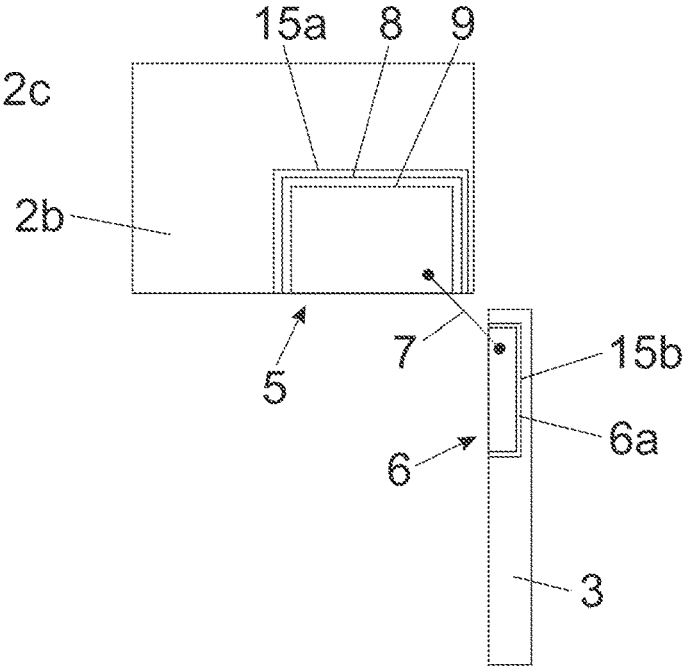

FIG. 2*a*-2*c* show the mounting procedure of the movable furniture part 3 on the furniture panel 2*b* of the furniture carcass 2 in schematic top views. A first recess 15*a* is formed in the furniture panel 2*b* for receiving the first fitting portion 5 of the furniture fitting 4, whereas a second recess 15*b* is arranged in the movable furniture part 3 for receiving the second fitting portion 6 of the furniture fitting 4. The first fitting portion 5 has at least a two-part configuration and includes a mounting portion 8 configured to be arranged within the first recess 15*a*, and a coupling portion 9 configured to be connected to the mounting portion 8. The first fitting portion 5 and the second fitting portion 6 are pivotally connected to one another by at least one hinged lever 7.

In a first mounting step (FIG. 2*b*), the mounting portion 8 is to be fixed within the first recess 15*a* of the furniture panel 2*b*, whereas the second fitting portion 6 is to be fixed to the movable furniture part 3. It is preferably provided that the longitudinal housing 6*a* of the second fitting portion 6 is configured to be substantially entirely countersunk within the second recess 15*b* of the movable furniture part 3. In a third mounting step (FIG. 2*c*), the mounting portion 8 and the coupling portion 9 are connected to one another, so that the movable furniture part 3 can be fixed to the furniture carcass 2.

Figure 3B:
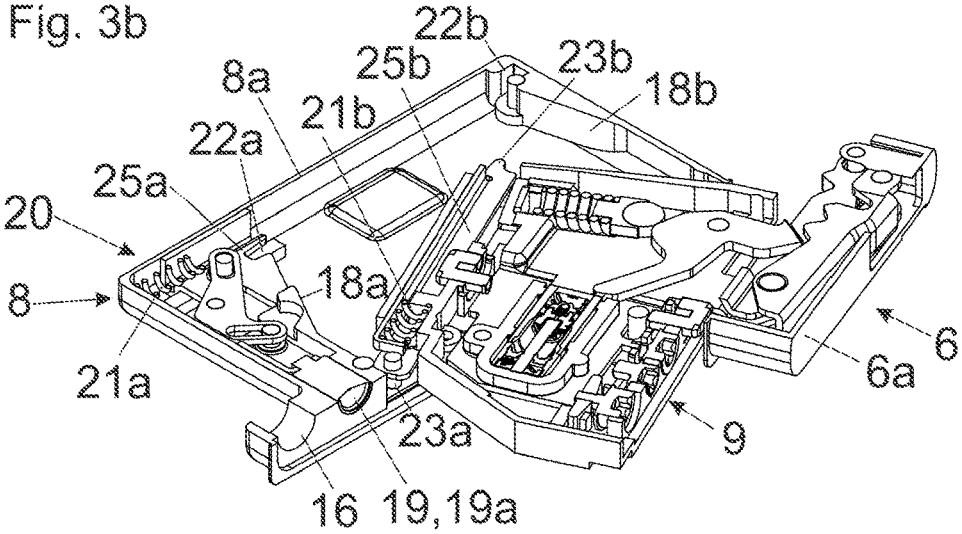
Figure 3C:
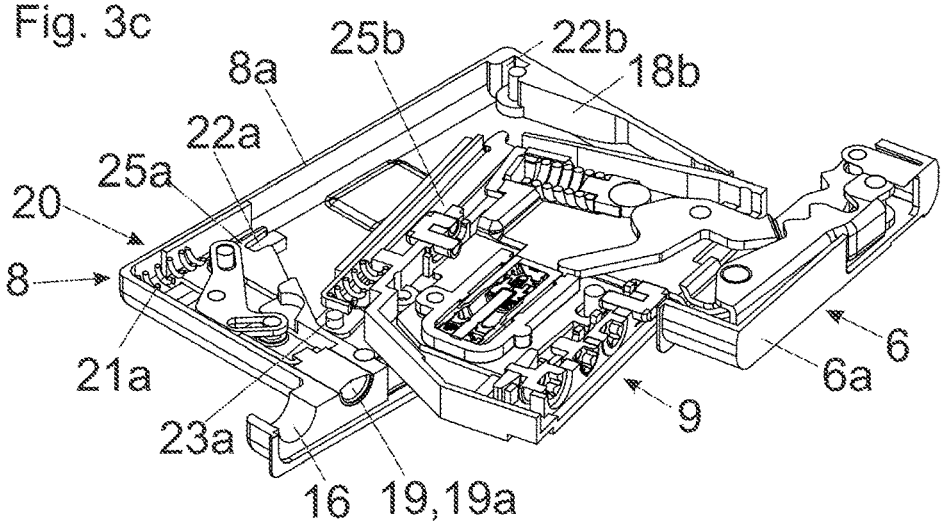

FIG. 3*a*-3*c* show the mounting procedure of the coupling portion 9 on the mounting portion 8 in different mounting steps. The coupling portion 9 is connected to the second fitting portion 6 by the at least one hinged lever 7. The hinged lever 7 is pivotally supported on the coupling portion 8 about a hinge axis 17*a*, and is pivotally supported on the second fitting portion 6 about the hinge axis 33*a*. The setting contour 24 is arranged on the hinged lever 7, and a pressure roller 12 pressurized by the spring device 10 is configured to run along the setting contour 24 upon a movement of the hinged lever 7 about the first hinge axis 17*a*. The hinged lever 7 is configured as a double-armed lever having a first lever end and a second lever end. The first lever end of the hinged lever 7 is hingedly connected to the second fitting portion 6 via the hinge axis 33*a*. The damping device 11 is configured to be acted upon by the second lever end of the hinged lever 7. The second lever end of the hinged lever 7, for performing a damping hub, can act on the damping device 11 either directly or via at least one further component (for example via an intermediate lever). In a first mounting step, the mounting portion 8 is to be fixed by at least one fixing device 16 (which may be configured, for example, as a hole for receiving a screw) to or within the furniture panel 2*b*

The mounting portion 8 can also include two or more fixing devices 16 configured as holes for receiving screws. It is also possible that the fixing device 16 includes a movably-mounted actuating element. The at least one locking element is configured to be moved by an actuation of the actuating element, and the mounting portion 8 can be fixed to or within the furniture panel 2*b* by the locking element in a force-locking manner.

In a further mounting step, the coupling portion 9 is inclinedly introduced into the pocket-shaped housing 8*a* of the mounting portion 8. Moreover, a centering device 18 for centering between the mounting portion 8 and the coupling portion 9 is provided. The centering device 18 includes at least one inclined surface portion 18*a*, 18*b* for guiding the coupling portion 9, the at least one inclined surface portion 18*a*, 18*b* being arranged on the mounting portion 8 and/or on the coupling portion 9.

For releasably locking between the coupling portion 9 and the mounting portion 8, at least one locking device 20 is advantageous. The locking device 20 includes at least one movably supported locking element 25*a* for releasably locking the coupling portion 9, the at least one locking element 25*a* being pressurized by a force storage member 21*a* (preferably configured as a compression spring). The locking element 25*a* is provided with a recess 22*a* for receiving a locking member 23*a* of the coupling portion 9. In the shown embodiment, a second force storage member 21*b* is provided, the second force storage member 21*b* being configured to push a second locking element 25*b* with a second locking member 23*b* in a direction of a second recess 22*b* of the mounting portion 8. As shown in FIG. 3*b* and FIG. 3*c*, the coupling portion 9 is laterally pivoted into the mounting portion 8, and the coupling portion 9 can be guided relative to the mounting portion 8 by the inclined surface portions 18*a*, 18*b* of the centering device 18.

Figure 4A:
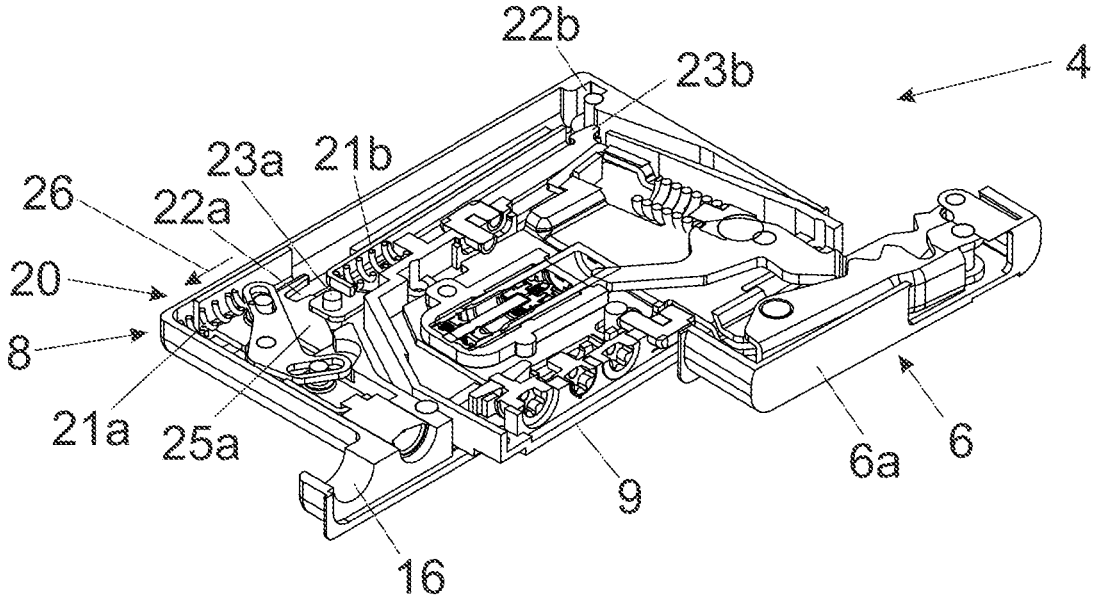
FIG. 4*a*, 4*b* show further temporal sequences of the mounting procedure of the coupling portion to the mounting portion in different cross-sectional views.

FIG. 4*a* shows, in relation to FIG. 3*c*, a continued pivoting movement of the coupling portion 9 relative to the mounting portion 8. The locking element 25*a* is pushed, against a force of the force storage member 21*a*, in a direction of the depicted arrow 26 due to the co-operation of the locking member 23*a* with an inclined surface portion of the locking element 25*a*. As result, the locking member 23*a* can enter into the recess 22*a* of the locking element 25*a*, and the second locking portion 23*b* can be pressed into the recess 22*b* of the mounting portion 8 by a force of the second force storage member 21*b*.

Figure 4B:
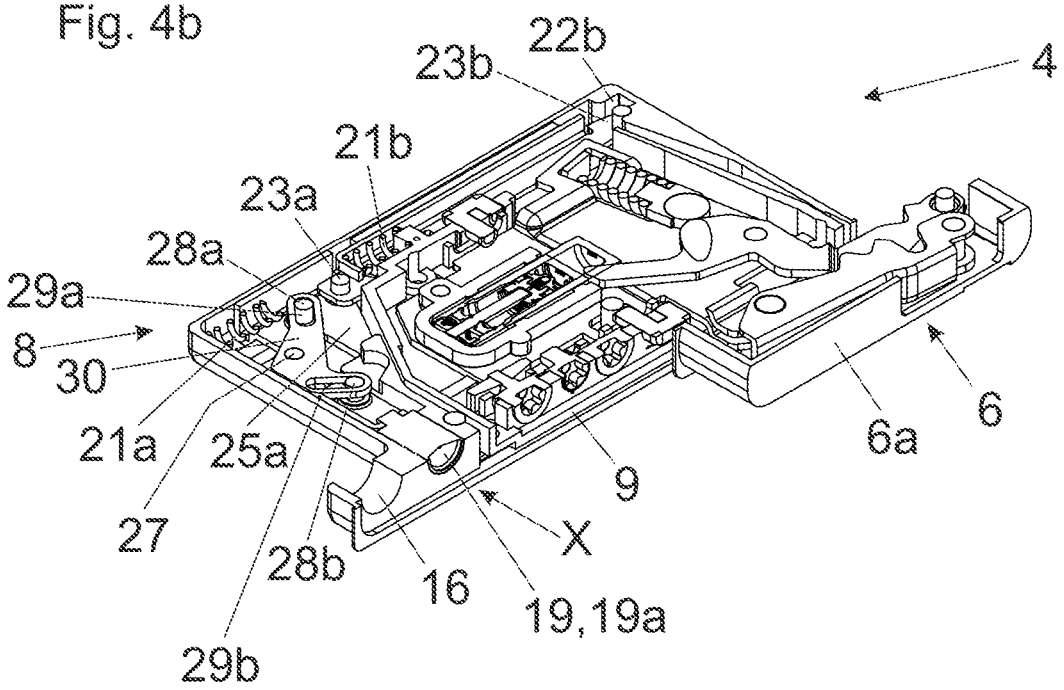

FIG. 4*b* shows the locked position between the mounting portion 8 and the coupling portion 9. By an unlocking device 19, the locking between the mounting portion 8 and the coupling portion 9 can be again released. The unlocking device 19 includes a movably-mounted, preferably linearly displaceable, release element 19*a*. By exerting a force to the release element 19*a* in the direction (X), the locking between the mounting portion 8 and the coupling portion 9 is configured to be released. The release element 19*a*, in the mounted condition of the furniture fitting 4, is immediately and directly accessible for an actuation with the aid of a tool.

In the shown embodiment, the unlocking device 19 includes a two-armed unlocking lever 30 pivotally supported about an axis 27. Elongated holes 29*a*, 29*b* are provided on both lever ends of the two-armed unlocking lever 30, the elongated holes 29*a*, 29*b* being provided for receiving pins 28*a*, 28*b*. The first pin 28*a* is arranged on the locking element 25*a*, whereas the second pin 28*b* is connected to the release element 19*a*. When the release element 19*a* is pushed in a direction (X) of the depicted arrow with the aid of a tool, preferably by a screwdriver, the locking element 25*a* is movable by the unlocking lever 30, against a force of the force storage member 21*a*, into a release position in which the locking between the mounting portion 8 and the coupling portion 9 can be released. It is preferably provided that the direction (X) extends substantially at a right angle to a front face of the first fitting portion 5.

Figure 5A:
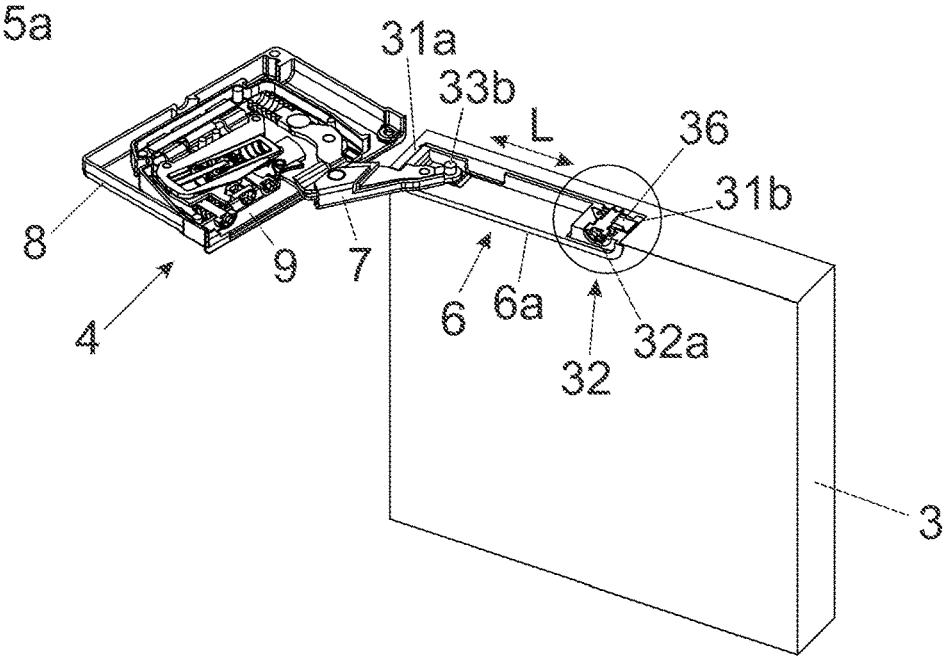
FIG. 5*a*-5*c* are different views of the second fitting portion to be fixed to the movable furniture part, in which the locking element is in a release position.

FIG. 5*a* shows the furniture fitting 4, in which the second fitting portion 6 with the housing 6*a* is to be fixed to the movable furniture part 3. The at least one hinge axis 33*b* is arranged on the first end section 31*a* of the housing 6, whereas the fastening device 32 with the rotatable actuating element 32*a* is arranged on the second end section 31*b*.

Figure 5B:
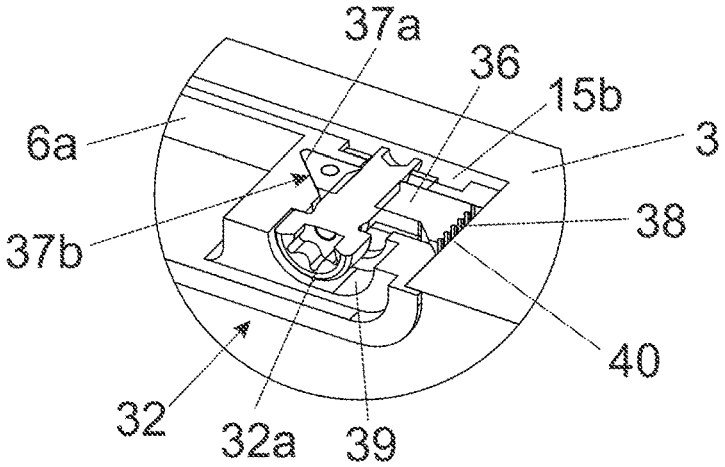

FIG. 5*b* shows the encircled region of FIG. 5*a* in an enlarged view. The actuating element 32*a* of the fastening device 32 is movement-coupled to at least one locking element 36. It is preferably provided that the actuating element 32*a* is in threading engagement with the locking element 36. The actuating element 32*a* is configured as a rotatable screw displaceably supported in a radial direction (for example with the aid of an elongated hole 39). The actuating element 32*a* can have a receiving device for a tool, so that the actuating element 32*a* can be rotated with the aid of the tool.

Figure 5C:
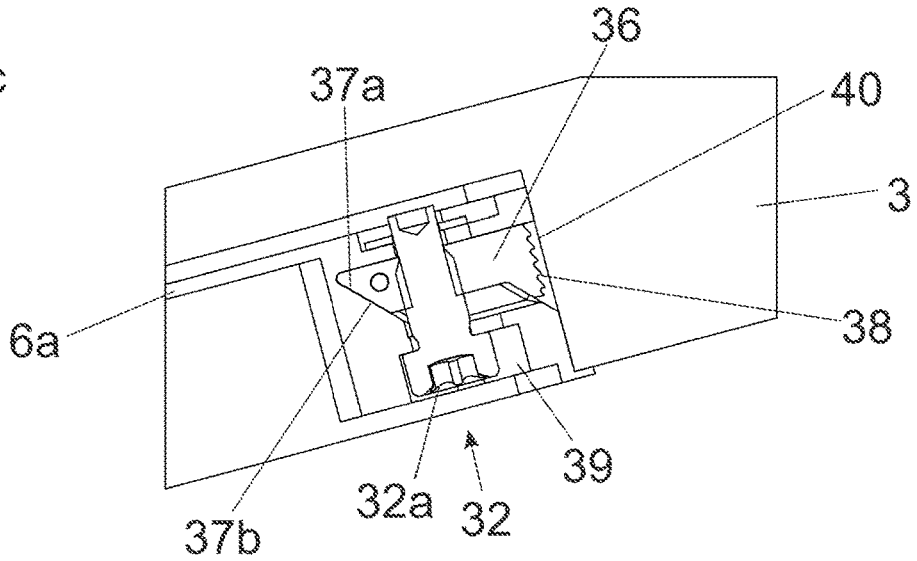

The locking element 36 has a first inclined surface portion 37*a* configured to co-operate with a corresponding second inclined surface portion 37*b*, the second inclined surface portion 37*b* being preferably arranged on the housing 6*a*. By rotating the actuating element 32*a* in a first rotational direction, the locking element 36 is movable in a first direction extending transversely to the rotational axis of the actuating element 32*a* due to the co-operation of the first and second inclined surface portions 37*a*, 37*b*. Therefore, the locking element 36 can be moved in a direction of a contact surface 40 of the recess 15*b* arranged in the movable furniture part 3. The locking element 36 has, at least over a region, a surface 38 for increasing the static friction, preferably a least one rib and/or at least one tooth arrangement, for bearing against the recess 15*b*. FIG. 5*c* shows a cross-sectional view in which the locking element 36 is spaced from the contact surface 40 of the recess 15*b* by the formation of a gap and is, therefore, located in a release position.

Figure 6A:
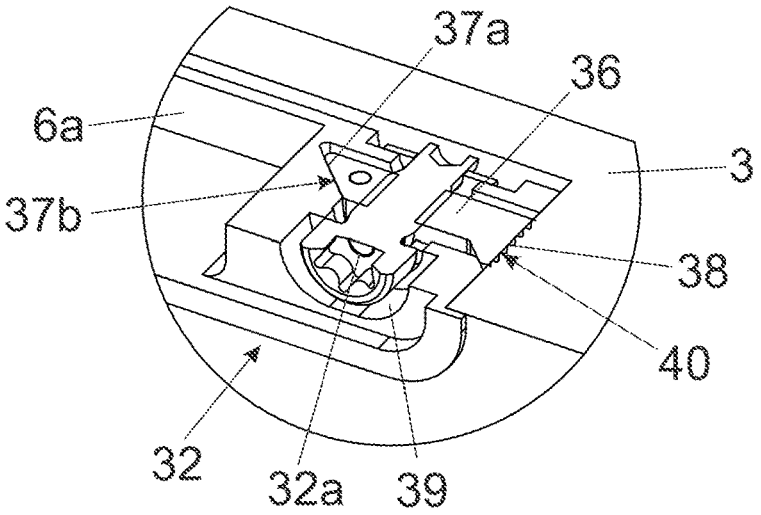
FIG. 6*a*-6*c* are different views of the second fitting portion fixed to the movable furniture part, in which the locking element is in a clamping position.

FIG. 6*a* shows the fixed condition of the second fitting portion 6 on the movable furniture part 3. Starting from the position according to FIGS. 5*a*-5*c*, the actuating element 32*a* has been rotated in the first rotational direction (in a clockwise direction) with the aid of a tool. By that rotational movement, the locking element 36 has been pulled closer to the head of the actuating element 32*a*. The locking element 36, due to the co-operation of the inclined surface portions 37*a*, 37*b* and due to the radial displaceability of the actuating element 32*a*, can be pressed against the contact surface 40 of the recess 15*b* arranged in the movable furniture part 3.

Figure 6B:
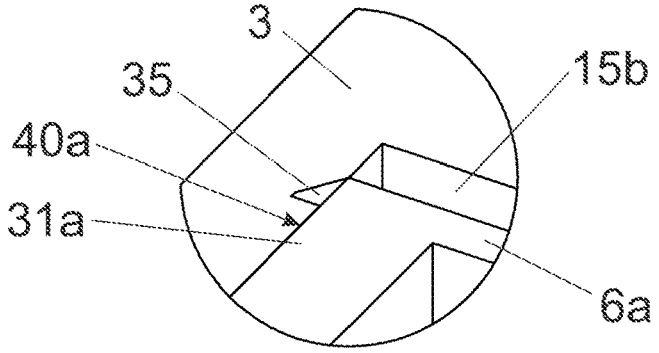

FIG. 6*b* shows the first end section 31*a*, on which the hinge axis 33*b* is arranged, of the housing 6*a*. By rotating the actuating element 32*a*, the longitudinal housing 6*a* has also been moved in a direction of an opposing second contact surface 40*a* of the recess 15*b*, and the protrusion 35 arranged on the second end section 31*a* of the housing 6*a* can be pressed against the second contact surface 40*a* of the recess 15*b* and/or can be penetrated into the second contact surface 40*a*. In this way, the housing 6*a* of the second fitting portion 6 can be clamped with both end sections 31*a*, 31*b* relative to both opposing contact surfaces 40, 40*a* of the recess 15*b*.

Figure 6C:
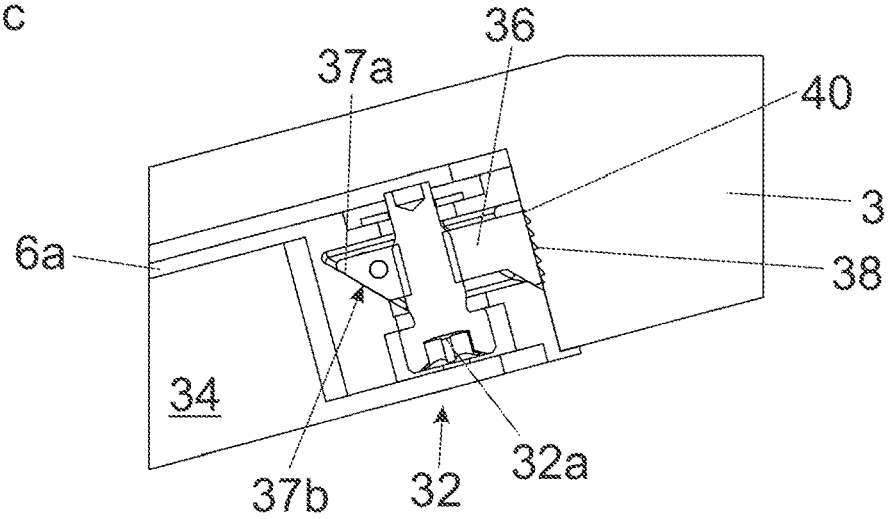

FIG. 6*c* shows a further cross-sectional view of the fastening device 32 arranged on the second end section 31*b* of the housing 6*a*, in which the locking element 36 is located in a fixed condition (clamping position) within the recess 15*b* in the movable furniture part 3.

The locking element 36 can be moved in a second direction, opposite the first direction, by rotating the actuating element 32*a* in a second rotational direction, opposite the first rotational direction, by the co-operation of the first and second inclined surface portions 37*a*, 37*b*. As a result, the distance between the surface 38 of the locking element 36 and the first contact surface 40 can be enlarged. In this way, the locking element 36 can be returned into the release position shown in FIG. 5*c*, so that the housing 6*a* of the second fitting portion 6 can be removed from the recess 15*b*, without damaging the contact surfaces 40, 40*a*.

Figure 7A:
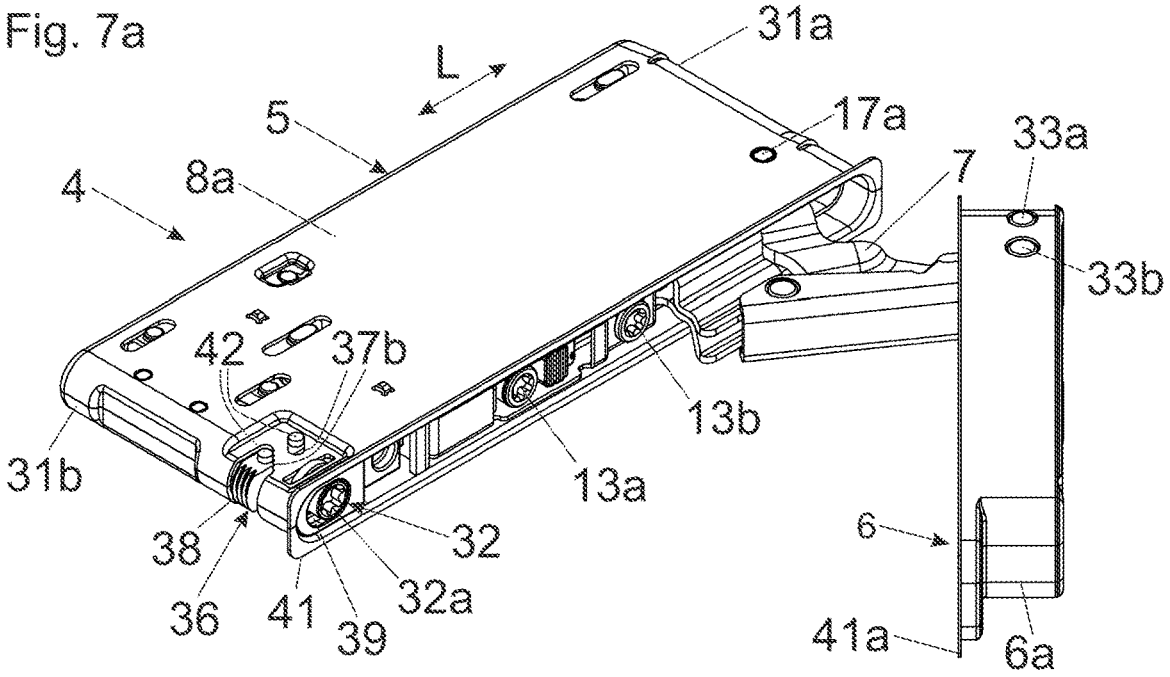
FIG. 7*a*-7*c* are a perspective view of a furniture fitting, in which the first fitting portion includes a fastening device for fastening to a furniture carcass, and two cross-sectional views with the fastening device in a release position and in a clamping position within the recess of the furniture carcass.

FIG. 7*a* shows a perspective view of the furniture fitting 4. The first fitting portion 5 includes at least one fastening device 32 for releasably fixing the housing 8*a* within the recess 15*a* of the furniture carcass 2. The housing 8*a* has two end sections 31*a*, 31*b* spaced from each other in the longitudinal direction (L), and the hinge axis member 17*a* of the hinged lever 7 is arranged in a region of the first end section 31*a*. The fastening device 32 having the rotatably mounted actuating element 32*a* in the form of a screw is arranged in a region of the second end section 31*b*. By at least one adjustment device 13*a*, 13*b*, a position of the housing 8*a* in relation to the furniture carcass 2, preferably in relation to the furniture panel 2*a* of the furniture carcass 2, can be adjusted. The fastening device 32 can be configured so as to be identical as the fastening device 32 shown in FIGS. 5*a*-5*c*, 6*a*-6*c*.

In the shown figure, the rotatable actuating element 32*a* is in threading engagement with the locking element 36, and the actuating element 32*a* is guided within the elongated hole 39 with radial play. At least one guide element 42, preferably in the form of a peg, is arranged on the locking element 36. The guide element 42, upon a rotation of the actuating element 32*a*, is displaceably guided along a, preferably inclinedly extending, guide 37*b* of the housing 8*a*. In this way, the locking element 36, with its surface 38 for increasing the static friction, can be pressed against an inner side of the recess 15*a* in the furniture carcass 2.

The housing 8*a* of the first fitting portion 5 and/or the housing 6*a* of the second fitting portion 6 can each have at least one laterally protruding flange 41, 41*a*. By a rear side of the flanges 41, 41*a*, a depth abutment member is formed, and the depth abutment member is configured to bear against a front face 43 of the furniture parts 2*a*, 3. Therefore, the fitting portions 5, 6, in a mounted condition, are held on a defined depth position in relation to the furniture panel 2*a* and/or in relation to the movable furniture part 3. Moreover, a gap formed between the fitting portions 5, 6 and the recesses 15*a*, 15*b* can be covered by the flanges 41, 41*a*. Further, a front face 43 arranged on an edge of the recesses 15*a*, 15*b* can be covered by the flanges 41, 41*a* in a mounted condition. In this way, an elaborate finishing of the edge, even if the edge is somewhat frayed, can be omitted.

Figure 7B:
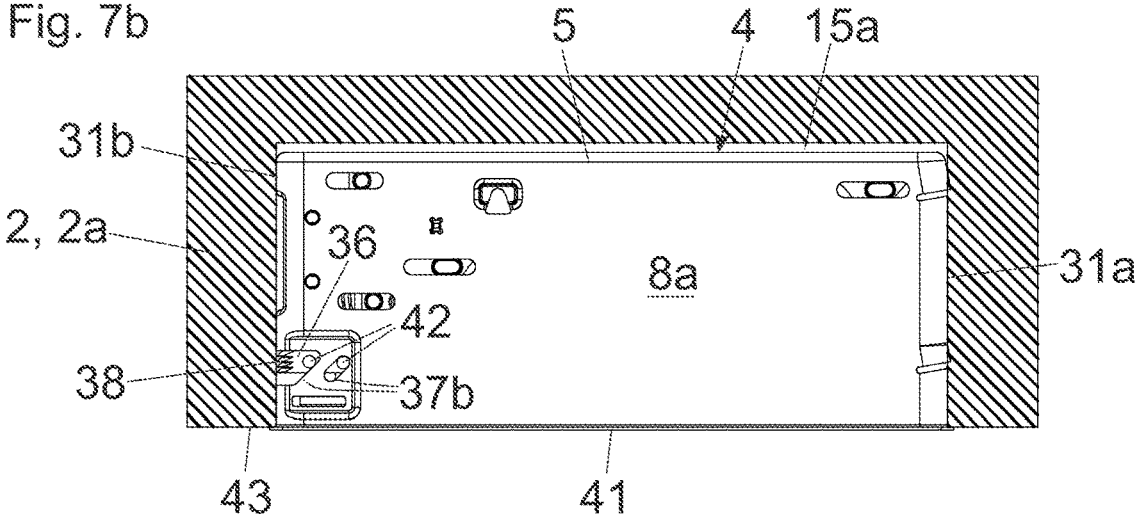

FIG. 7*b* shows the housing 8*a* of the first fitting portion 5 in a release position of the fastening device 32, the housing 8*a* being countersunk in the furniture carcass 2, preferably within the furniture panel 2*a*. It is thereby visible that the surface 38 of the locking element 36 is not yet pressed against a corresponding inner side of the recess 15*a*.

Figure 7C:
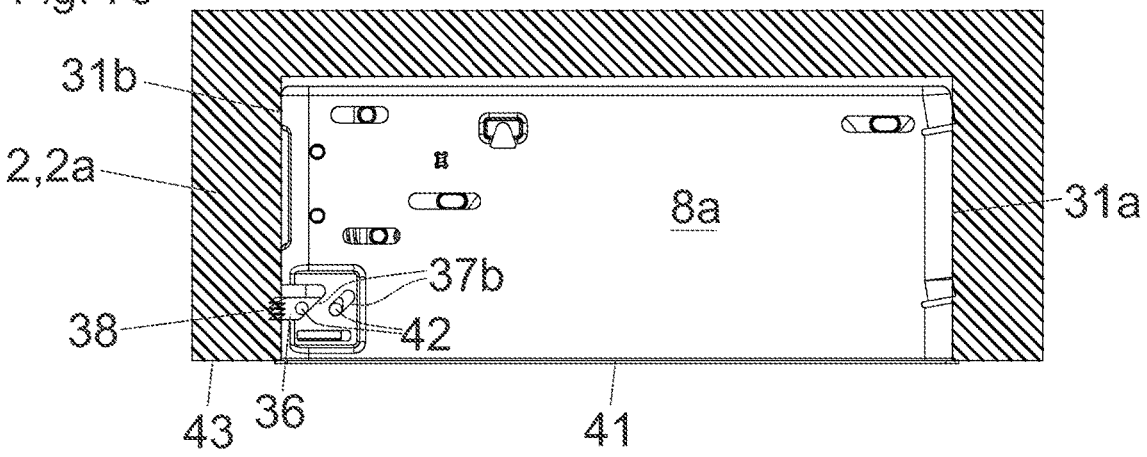

FIG. 7*c* shows the housing 8*a* of the first fitting portion 5 in a clamping position of the fastening device 32, the housing 8*a* being countersunk in the furniture carcass 2, preferably within the furniture panel 2*a*. By rotating the actuating element 32*a*, the two guide elements 42 of the locking element 36 have been moved along the guides 37*b*, and the surface 38 of the locking element 36 can be pressed onto or pressed into the inner side of the recess 15*a*.

Figure 8A:
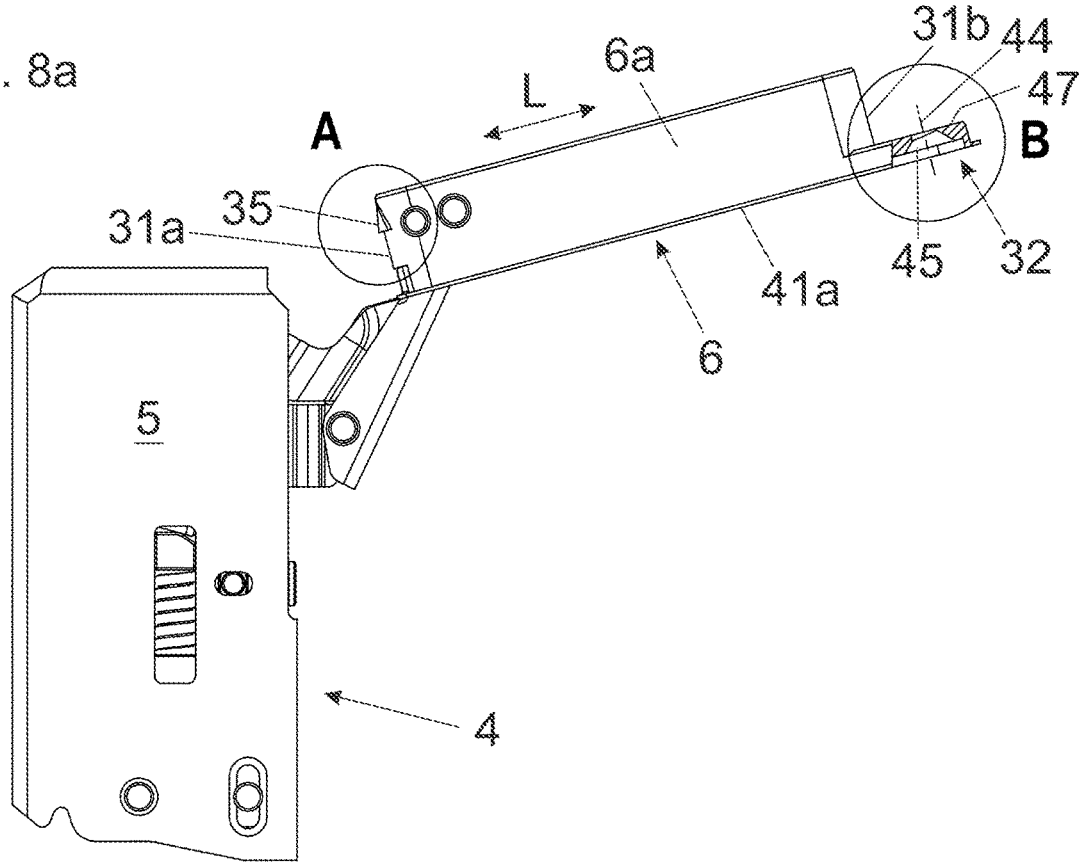
FIG. 8*a*-8*d* show a further embodiment of a fastening device for fastening the fitting portions to the furniture carcass and/or to the movable furniture part.

FIG. 8*a* shows a further embodiment of a fastening device 32 for fastening the fitting portions 5, 6 to the furniture carcass 2 and/or to the movable furniture part 3. The fastening device 32, in the shown figure, will be described in connection with the second fitting portion 6 configured to be fixed to the movable furniture part 3. Of course, the fastening device 32 can also be utilized in connection with the first fitting portion 5.

The fitting portion 6 includes a fastening surface 47 for bearing against the movable furniture part 3, the fastening surface 47 being configured to be flat at least over a region. The fastening device 32 arranged on the second end section 31*b* of the housing 6 includes a bore 45 having a longitudinal direction extending transversely, for example between 10° and 20°, to a perpendicular 44 extending at a right angle to the fastening surface 47. At least one laterally protruding protrusion 35 is arranged on the first end section 31*a* of the housing 6*a*, and the function of the protrusion 35 has already been described in connection with FIG. 6*b*.

Figure 8B:
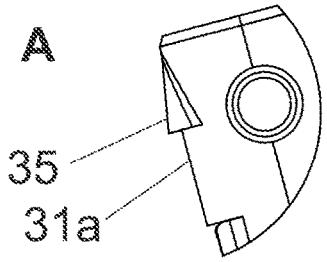

FIG. 8*b* shows the encircled detail region "A" of FIG. 8*a* in an enlarged view.

Figure 8C:
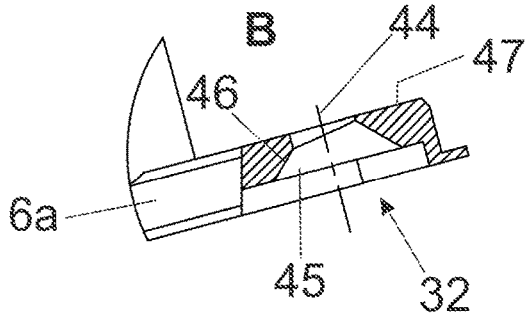

FIG. 8*c* shows the encircled detail region "B" of FIG. 8*a* in an enlarged view, in which the inclinedly extending bore 45 with an inclined surface portion 46 is shown.

Figure 8D:
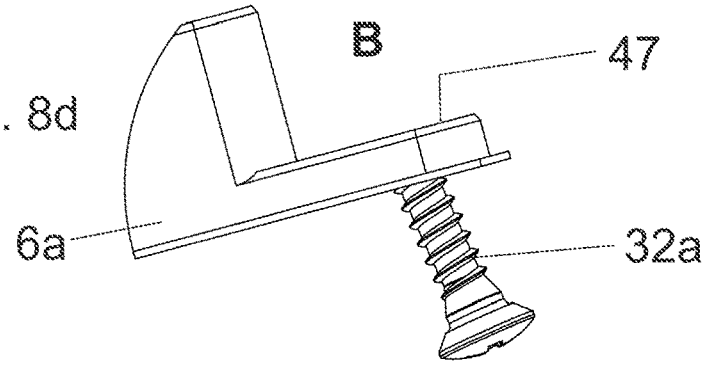

FIG. 8*d* shows the actuating element 32*a* in the form of a rotatable screw, the longitudinal axis of which is tilted in relation to the fastening surface 47 due to the inclinedly extending bore 45. When the actuating element 32*a* in the form of the screw is rotated, the inclined surface portion 46 of the bore 45 is contacted by the actuating element 32*a*. In this way, the housing 6*a* of the second fitting portion 6 is movable in the longitudinal direction (L), and the protrusion 35 of the first end section 31*a* is pressed against an inner side of the recess 15*b*, and both end sections 31*a*, 31*b* of the housing 6*a* can be fixed within the recess 15*b*.

In the shown figure, the bore 45 is configured asymmetrical in relation to the perpendicular 44. The inclined surface portion 46 of the bore 45 is inclined such that the actuating element 32*a* contacts the inclined surface portion 46 upon a rotational movement of the actuating element 32*a*, and the housing 6*a* is movable in a direction extending transversely to the perpendicular 44 by the actuating element 32*a*.

The invention claimed is:

1. A furniture fitting for movably supporting a movably-mounted furniture part relative to a furniture carcass, the furniture fitting comprising:

a first fitting portion configured to be fixed to the furniture carcass; and a second fitting portion configured to be fixed to the movable furniture part, the first and second fitting portions being pivotally connected to one another by a hinge axis member, wherein one of the first and second fitting portions is configured to be at least partially inserted into a recess in a corresponding one of the furniture carcass and the movable furniture part to which the one of the first and second fitting portions is to be fixed, wherein the one of the first and second fitting portions includes a longitudinal housing having first and second end sections spaced from each other in a longitudinal direction, wherein the hinge axis member is arranged on the first end section of the housing, wherein the one of the first and second fitting portions includes a fastening device having a movably-mounted actuating element in the form of a rotatable screw, wherein by an actuation of the actuating element, the one of the first and second fitting portions is configured to be fixed within the recess on both end sections of the housing, wherein a locking element is configured to be moved by an actuation of the actuating element, and the housing is configured to be fixed within the recess by the locking element, and wherein the actuating element is movement-coupled to the locking element.

2. The furniture fitting according to claim 1, wherein the actuating element of the fastening device is arranged on a region separate from the first end section, on which the hinge axis member is arranged, of the housing.

3. The furniture fitting according to claim 1, wherein the actuating element of the fastening device is arranged on the second end section of the housing.

4. The furniture fitting according to claim 1, wherein the one of the first and second fitting portions of the furniture fitting has precisely one fastening device.

5. The furniture fitting according to claim 1, wherein the locking element includes a first inclined surface portion configured to co-operate with a corresponding second inclined surface portion, the locking element being configured to be moved, upon rotating the actuating element in a first rotational direction, in a first direction extending transversely to a rotational axis of the actuating element by the co-operation of the first and second inclined surface portions.

6. The furniture fitting according to claim 5, wherein the locking element is configured to be moved, upon rotating the actuating element in a second rotational direction opposite the first rotational direction, in a second direction opposite the first direction by the co-operation of the first and second inclined surface portions.

7. The furniture fitting according to claim 5, wherein the locking element includes a guide element configured to be displaced along the first and second inclined surface portions.

8. The furniture fitting according to claim 1, wherein the locking element includes, at least over a region, a surface for increasing static friction between the locking element and a surface of the recess.

9. The furniture fitting according to claim 8, wherein the surface for increasing static friction comprises at least one rib or at least one tooth arrangement configured to bear against the surface of the recess.

10. The furniture fitting according to claim 1, wherein the housing of the one of the first and second fitting portions is configured so as to be substantially cuboid-shaped.

11. The furniture fitting according to claim 1, wherein the housing, on the first end section on which the hinge axis member is arranged, includes at least one protrusion configured to bear against a surface of the recess.

12. The furniture fitting according to claim 1, wherein the first fitting portion is configured to be fixed to a first furniture panel of the furniture carcass, wherein the second fitting portion is configured to be fixed to a second furniture panel, the second furniture panel being the movable furniture part, and wherein the recess into which the one of the first and second fitting portions is configured to be at least partially inserted is a recess in a corresponding one of the first and second furniture panels to which the one of the first and second fitting portions is to be fixed.

13. The furniture fitting according to claim 1, wherein the second fitting portion includes the longitudinal housing as a first housing, and the first fitting portion includes a second housing having at least one fixing device for mounting the second housing to the furniture carcass, and the first fitting portion includes at least one coupling portion hingedly connected to the second fitting portion, the at least one coupling portion being configured to be releasably connected to the second housing.

14. The furniture fitting according to claim 1, wherein the one of the first and second fitting portions includes at least one laterally protruding flange configured to bear against the corresponding one of the furniture carcass and the movable furniture part.

15. The furniture fitting according to claim 14, wherein the at least one flange is configured to bear against a front face of the corresponding one of the furniture carcass and the movable furniture part.

16. The furniture fitting according to claim 1, wherein the furniture fitting is configured as a furniture hinge.

17. An item of furniture comprising a furniture carcass, a furniture part movably supported relative to the furniture carcass, and the furniture fitting according to claim 1 for moving the furniture part relative to the furniture carcass.

18. The furniture fitting according to claim 1, wherein the actuating element is in threading engagement with the locking element.

19. A furniture fitting for movably supporting a movably-mounted furniture part relative to a furniture carcass, the furniture fitting comprising:

a first fitting portion configured to be fixed to the furniture carcass; and a second fitting portion configured to be fixed to the movable furniture part, the first and second fitting portions being pivotally connected to one another by a hinge axis member, wherein one of the first and second fitting portions is configured to be at least partially inserted into a recess in a corresponding one of the furniture carcass and the movable furniture part to which the one of the first and second fitting portions is to be fixed, wherein the one of the first and second fitting portions includes a longitudinal housing having first and second end sections spaced from each other in a longitudinal direction, wherein the hinge axis member is arranged on the first end section of the housing, wherein the one of the first and second fitting portions includes a fastening device having a movably-mounted actuating element in the form of a rotatable screw, wherein by an actuation of the actuating element, the one of the first and second fitting portions is configured to be fixed within the recess on both end sections of the housing, and wherein the one of the first and second fitting portions includes a fastening surface configured to bear against the corresponding one of the furniture carcass and the movable furniture part, the fastening device including at least one bore having a longitudinal direction for the passage of the actuating element, the longitudinal direction of the bore extending inclinedly to a perpendicular extending at a right angle to the fastening surface.

20. The furniture fitting according to claim 19, wherein the at least one bore is configured so as to be asymmetrical in relation to the perpendicular.

21. The furniture fitting according to claim 19, wherein the at least one bore includes an inclined surface portion configured to be inclined such that the actuating element, upon a rotational movement, contacts the inclined surface portion, and the housing is movable in a direction transversely to the perpendicular by the actuating element.

22. A furniture fitting for movably supporting a movably-mounted furniture part relative to a furniture carcass, the furniture fitting comprising:

a first fitting portion configured to be fixed to the furniture carcass; and a second fitting portion configured to be fixed to the movable furniture part, the first and second fitting portions being pivotally connected to one another by a hinge axis member, wherein one of the first and second fitting portions is configured to be at least partially inserted into a recess in a corresponding one of the furniture carcass and the movable furniture part to which the one of the first and second fitting portions is to be fixed, wherein the one of the first and second fitting portions includes a longitudinal housing having first and second end sections spaced from each other in a longitudinal direction, wherein the hinge axis member is arranged on the first end section of the housing, wherein the one of the first and second fitting portions includes a fastening device having a movably-mounted actuating element in the form of a rotatable screw, wherein by an actuation of the actuating element, the one of the first and second fitting portions is configured to be fixed within the recess on both end sections of the housing, wherein a locking element is configured to be moved by an actuation of the actuating element, and the housing is configured to be fixed within the recess by the locking element, and wherein the locking element includes a first inclined surface portion configured to co-operate with a corresponding second inclined surface portion, the locking element being configured to be moved, upon rotating the actuating element in a first rotational direction, in a first direction extending transversely to a rotational axis of the actuating element by the co-operation of the first and second inclined surface portions.

* * * * *